US005902149A

United States Patent [19]

Tashiro et al.

[11] Patent Number: 5,902,149

[45] Date of Patent: May 11, 1999

[54] MOVABLE CONNECTOR

[75] Inventors: Harunori Tashiro; Kiyohito Fukuda, both of Shizuoka, Japan

[73] Assignee: Yazaki Corporation, Tokyo, Japan

[21] Appl. No.: 08/986,641

[22] Filed: Dec. 8, 1997

[30] Foreign Application Priority Data

Dec. 10, 1996 [JP] Japan ..... 8-329915

[51] Int. Cl.[6] ..... H01R 13/73

[52] U.S. Cl. ..... 439/557; 439/247

[58] Field of Search ..... 439/557, 248, 439/247, 246, 252

[56] References Cited

U.S. PATENT DOCUMENTS 5,820,394 10/1998 Kameyama et al. ..... 439/248

FOREIGN PATENT DOCUMENTS 63-125310 8/1988 Japan .

*Primary Examiner*—Gary Paumen
*Assistant Examiner*—Antoine Ngandjui
*Attorney, Agent, or Firm*—Armstrong, Westerman, Hattori, McLeland & Naughton

[57] ABSTRACT

A movable connector is provided. The connector is inserted into a panel hole so as to engage stoppers of movable locking arms with the inner rim of the panel hole. Thus, the connector can be movably mounted to the panel by virtue of the elasticity of the movable locking arms. Fixed locking members each having a stopper head at the top of the pin are provided outside the movable locking arms, while locking member receiving holes are formed through the panel. When the connector moves toward one side within the panel hole and approaches or reaches the disengagement position, where the movable locking arm on the opposite side is disengaged from the panel hole, the bottom surface of the stopper head of the corresponding fixed locking member is engaged with the rim of the corresponding locking member receiving hole so as to re-lock the connector to the panel.

3 Claims, 4 Drawing Sheets

MOVABLE CONNECTOR

BACKGROUND OF THE INVENTION

1. Field of the Invention

The present invention relates to a movable connector having an alignment mechanism connected through a hole on a panel of a vehicle, and more particularly to an improved movable connector which does not fall off even if a movable locking arm is unexpectedly disconnected from the panel hole.

2. Related Art

FIG. 4 shows a movable connector having a conventional alignment mechanism mounted onto a panel at its hole.

Reference numeral 1 shows a connector holder for holding a plurality of connectors C indicated by an alternate long and two short dashes line. The connector holder 1 takes the form of a shallow box made of synthetic resin or light metal. A flange 12 is formed around a bottom wall 11, and movable locking arms 2 and 2' protrude from the both sides of the bottom surface of the flange 12. The movable locking arms 2 and 2' extend forward from the flange 12 via sprung mounting base portions 21. A hook-type stopper 22 is formed on the edge of each of the movable locking arms 2 and 2'. The sprung mounting base portions 21 and the locking arms 2 and 2' have elasticity.

In the center of the connector holder 1, a guide rod 13 is provided for guiding and engaging the connectors C with mating connectors (not shown). A guide taper 14 is provided on the tip end of the guide rod.

When the connector holder 1 is inserted into a panel hole 31 of a panel 3 of a vehicle, the movable locking arms 2 and 2' are elastically bent toward the connector holder 1, and then the movable locking arms 2 and 2' elastically return to its home position when the edges of the stoppers 22 move out of the panel hole 31. Thus, the stoppers 22 engage with the rim of the panel hole 31 at the front surface 3*a* of the panel 3, and the flange 12 is brought into contact with the rear surface 3*b* of the panel 3, so that the connector holder 1 can be locked into the panel hole 31 and prevented from slipping off in either forward or backward direction.

When the locking of the connector holder 1 is in progress or complete, the connector holder 1 is movable in the direction of arrows Y and Y' within the panel hole 31 by bending the movable locking arms 2 and 2'. The connector holder 1 can also be movable in X-Y direction (not shown in the figure), which is perpendicular to the Y–Y' direction.

Accordingly, even if the connectors C is not aligned with the mating connectors that are provided on the front surface 3*a* of the panel 3 in advance, they can be automatically aligned with each other by simply inserting the connector holder 1 into the panel hole 13 by virtue of the guide rod 13 having the guide taper 14, and the elastically movable locking arms 2 and 2'. Thus, the engaging operation and the locking operation can be easily performed.

However, if the connector holder 1 greatly deviates toward one side (toward Y', for instance) as shown in FIG. 5, the stopper 22 of the movable locking arm 2 is disengaged from the panel hole 31 on the opposite side (on the Y side), resulting in slipping off of the connector holder 1 from the panel 3 in the direction of an arrow P.

Such deviation of the connector holder 1 toward one side may occur, aside from considerable off-centering of the connectors, when it is mounted to the panel hole 31 or when the connection wires (not shown) of the connectors C are subject to a tension force caused externally.

SUMMARY OF THE INVENTION

The principal object of the present invention is to provide a movable connector which will not fall off the panel even if a movable locking arm unexpectedly is disengaged from the panel hole on a panel of a vehicle or the like, and the mounting of which is safe and easy.

In the following description, "connector" refers to a connector itself, a connector holder for receiving and holding the connector, or a connector holder holding the connector, unless otherwise specified.

To achieve the above object, the present invention provides a movable connector having a plurality of locking arms each provided with a stopper at its edge portion via a mounting base member around the outer periphery of the connector. The connector is inserted into the panel hole of a panel for a vehicle to engage the stopper with the rim of the panel hole. By doing so, the movable connector can be movably mounted to the panel hole by utilizing the elasticity of the movable locking arms. The movable connector comprises fixed locking members each having a stopper head at the top of a pin outside the movable locking arms. Locking member receiving holes are formed through the panel. When the connector moves toward one side within the panel hole to approach or reach the disengagement position, where the movable locking arm on the opposite side is disengaged from the panel hole, the connector is brought into a re-locked state by the engagement of the bottom surface of the stopper head of the fixed locking member with the rim of the locking member receiving hole.

According to the present invention, the locking member receiving holes are formed through the panel for receiving the fixed locking members for the connector. When the connector is inserted into the panel hole, the stopper of each movable locking arm is blocked by the rim of the panel hole. Thus, the locking is performed and the mounting of the connector can be made easy.

The locking members are provided outside the movable locking arms of the connector, each having a stopper head at the top of the pin. When the connector moves toward one side within the panel hole to approach or reach the disengagement position, where the movable locking arm on the opposite side is disengaged from the panel hole, the bottom surface of the stopper head of the fixed locking member is engaged with the rim of the locking member receiving hole so as to re-lock the connector. Thus, the connector can be prevented from unexpectedly falling off the panel to maintain its safety.

The above and other objects and features of the present invention will be more apparent from the following description taken in conjunction with the accompanying drawings.

DESCRIPTION OF THE PREFERRED EMBODIMENTS

The following is a description of an embodiment of the present invention, with reference to the attached drawings.

Figure 1:
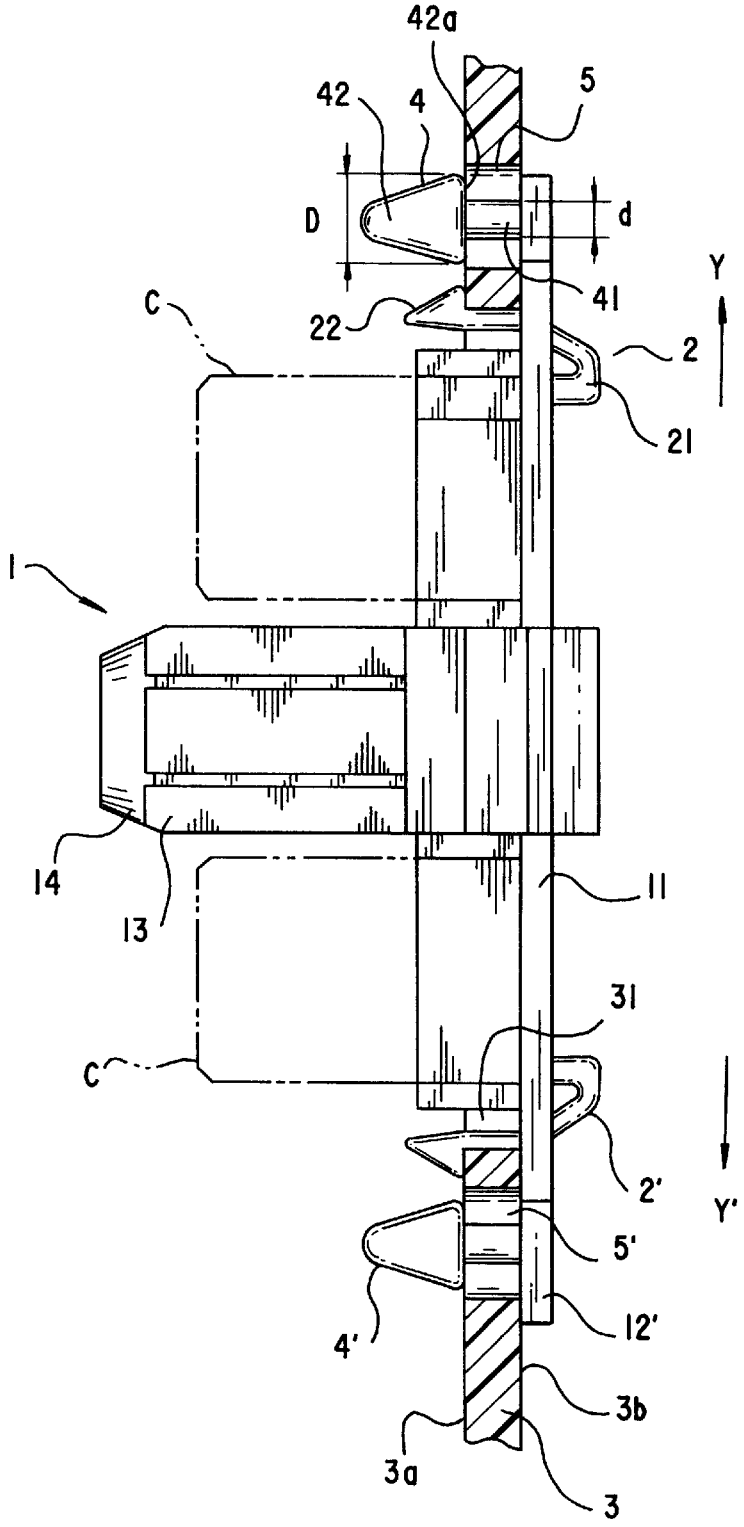
FIG. 1 is a sectional view of a mounted movable connector according to the present invention.

In FIG. 1, a connector holder 1 has a guide rod 13 in the center of the bottom wall 11. The guide rod 13 is provided with a guide taper 14 at the edge portion. The connector holder 1 also has movable locking arms 2 and 2' extending forward via sprung mounting base members 21 from the rear side of a flange 12'. A hook-type stopper 22 is formed at the edge of each locking arm.

The connector holder 1 is inserted into a panel hole 31 of a panel 3, so that the stopper 22 can be engaged with the rim of the panel hole 31 on the panel front surface 3*a,* and that the flange 12' is brought into contact with the panel rear surface 3*b*. Thus, the connector holder 1 can be locked to the panel hole 31, movable in the direction of Y–Y' (and the direction perpendicular to Y–Y') by the elasticity of the movable locking arms 2 and 2'.

Figure 2:
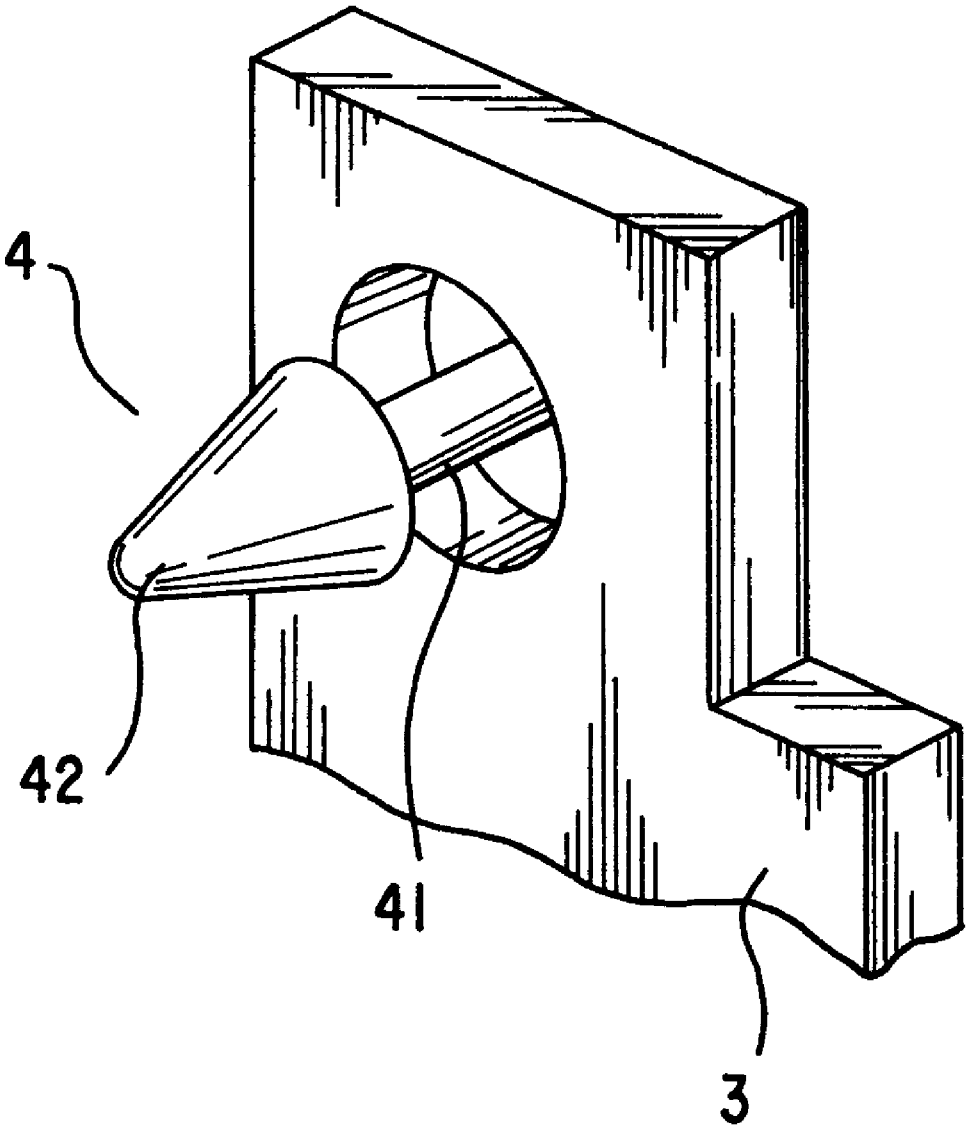
FIG. 2 is an enlarged perspective view of a fixed locking member shown in FIG. 1.

The flange 12' of the present invention is larger in size than the flange 12 of the prior art. As shown in FIG. 2, fixed locking members 4 and 4' each having a stopper head 42 at the edge of a pin 41 are provided on the extended portion of the flange 12' outside the movable locking arms 2 and 2'. To receive the fixed locking members 4 and 4', locking member receiving holes 5 and 5' are formed through the panel 3.

The diameter d of the pin 41 is made smaller than the diameter D of the bottom surface 42*a* of the stopper head 42, so that the pin 41 can move within the locking member receiving holes 5 and 5', following the movement of the connector holder 1 in the direction of Y–Y'. Although the stopper head 42 has a conical shape in this embodiment, it is not limited thereto. The stopper head 42 may take the form of a disk or a button which is tapered around the upper rim. In other words, the stopper head 42 may take any form as long as it is tapered and has the bottom surface 42*a* to be hooked by the locking member receiving holes 5 and 5'.

Figure 3:
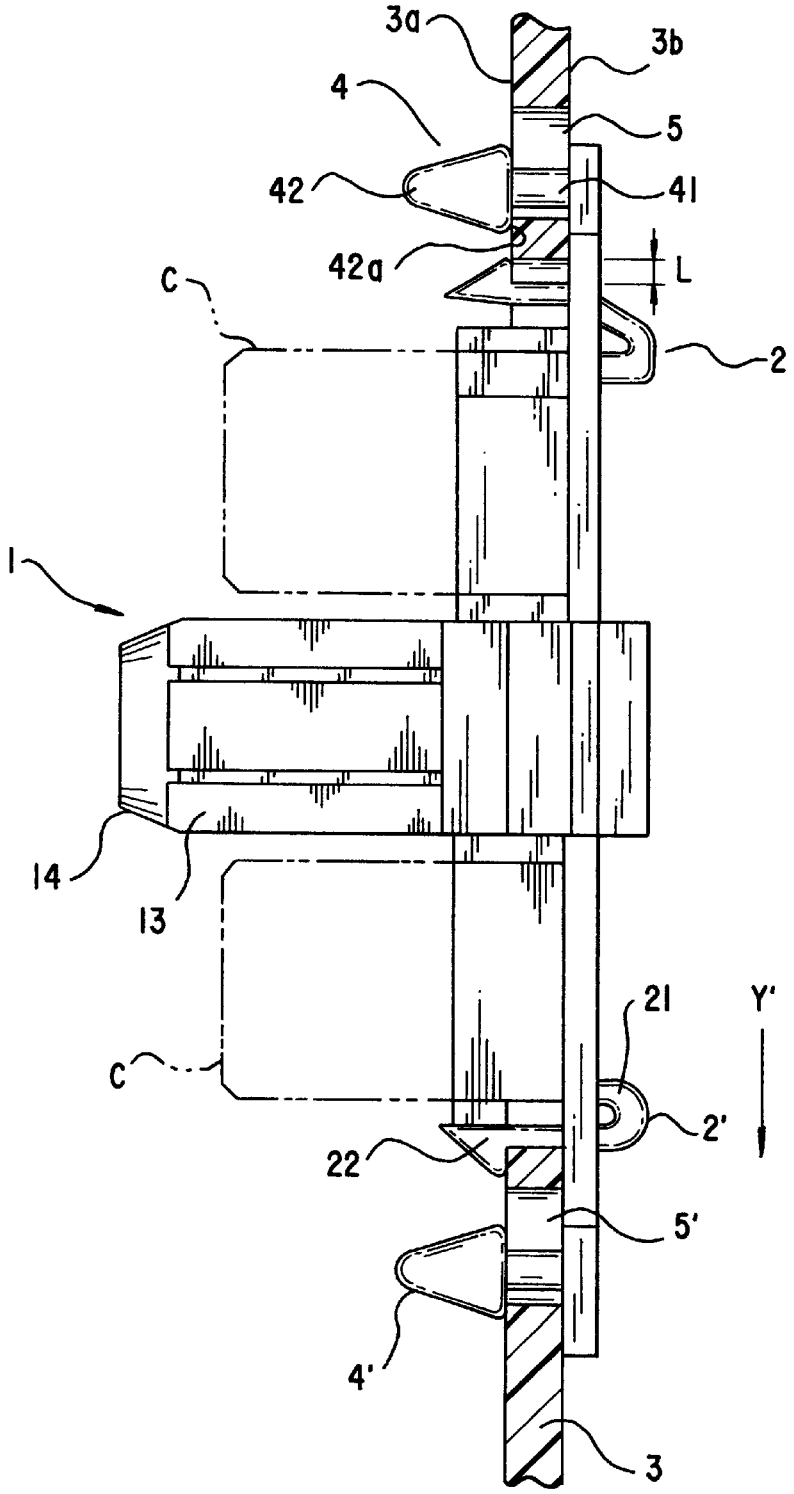
FIG. 3 is a sectional view of the movable connector shown in FIG. 1 in operation.
Figure 5:
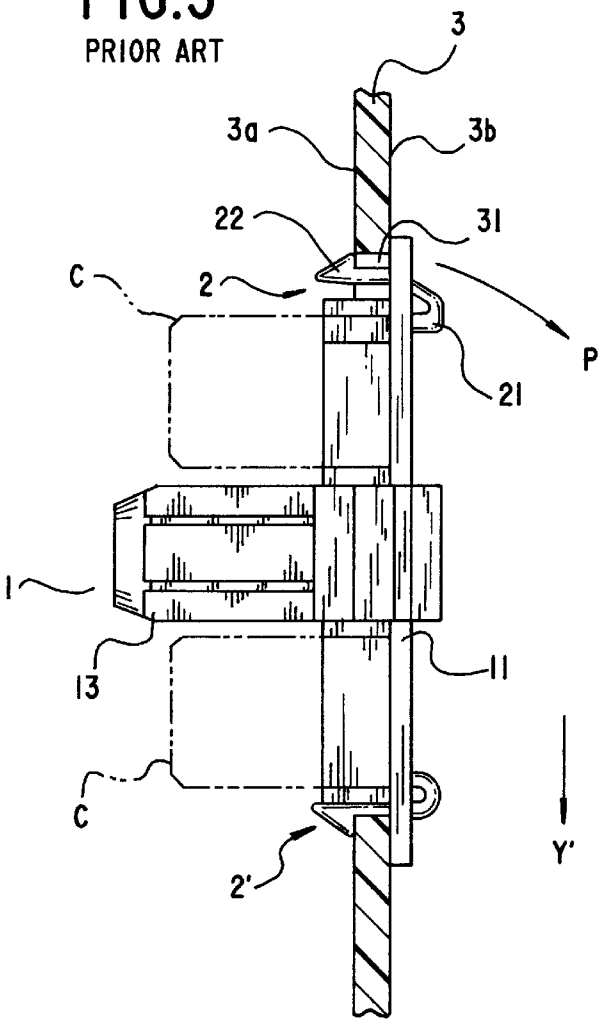
FIG.5 PRIOR ART
FIG. 5 is a sectional view of the conventional movable connector shown in FIG. 4 in operation.
Figure 4:
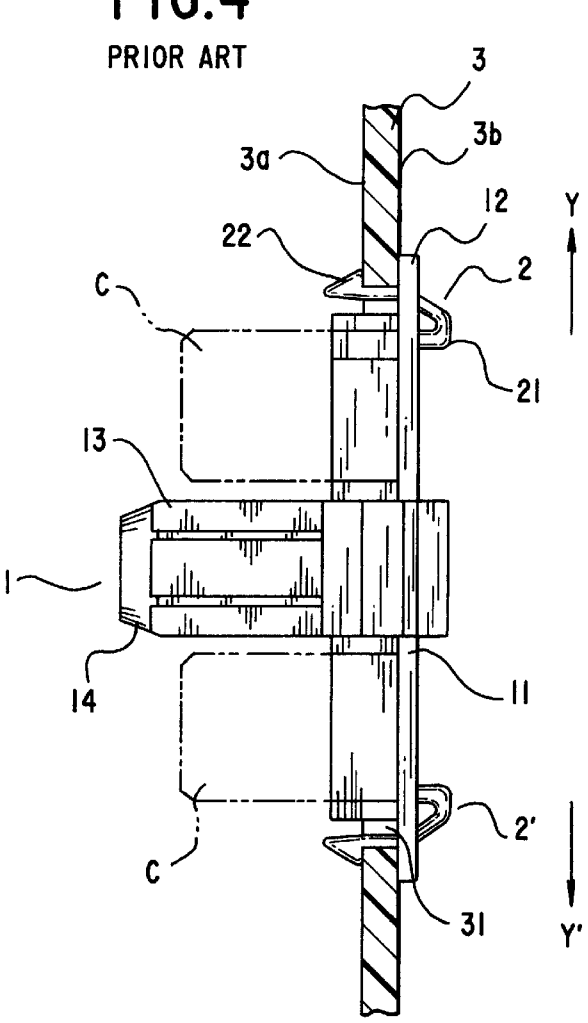
FIG.4 PRIOR ART
FIG. 4 is a sectional view of a mounted conventional movable connector.

With this structure, even if the stopper 22 of the movable locking arm 2 is disengaged from the panel hole 31 because of the displacement of the connector holder 1 toward Y' as in FIG. 5, the connector holder 1 is re-locked to the panel 3, because the bottom surface 42*a* of the stopper head 42 of each of the fixed locking members 4 and 4' is engaged with the rim of each of the locking member receiving holes 5 and 5', as shown in FIG. 3. Accordingly, the connector holder 1 will never fall off the panel 3 unlike the connector holder of the prior art.

The bottom surface 42*a* of the stopper head 42, which is the heel of engagement for the rim of the locking member receiving hole 5, is at least large enough to engage with the rim of the locking member receiving hole 5 when the stopper 22 of the movable locking arm 2 (or the connector holder 1) has moved toward one side by the length L to be disconnected from the panel hole 31. More preferably, the bottom surface 42*a* of the stopper head 42 should start engaging with the rim of the locking member receiving hole 5 when the stopper 22 of the movable locking arm 2 has moved toward one direction by the length L/2.

In the above embodiment, the connector holder 1 for accommodating and holding connectors C are provided with movable locking arms 2 and 2', and the fixed locking members 4 and 4'. However, the movable locking arm 2 and the fixed locking member 4 may be provided directly to the connectors C. Thus, the same effects can be obtained from the connectors only, the connector holder to accommodate and hold the connectors, or the connector holder holding the connectors which serves as a movable connector.

In the above embodiment, the number of movable locking arms 2 and 2', and the number of fixed locking members 4 and 4' are both two in number, so that they are positioned outside the connector holder 1 at two opposing sides. However, in the case where the connector holder 1 is of a cylindrical shape, three or four locking arms and fixed locking members may be provided on the periphery of the connector holder 1. In other words, a plurality of locking arms and fixed locking members may be provided as long as the connector holder 1 is securely locked in a movable state within the panel hole 31 in the direction of Y–Y'.

As described so far, the movable connector of the present invention has movable locking arms on the outer periphery of the connector and fixed locking member having a stopper on the top of the pin. Locking member receiving holes are formed through the panel. When the connector moves within the hole toward one side and the movable locking arm on the opposite side is disconnected from the panel hole, the movable locking arm is re-locked because the bottom surface of the stopper of the fixed locking member is blocked by the rim of the locking member receiving hole. Even if the movable locking arm is disconnected from the panel, the connector can be prevented from falling off the panel. Thus, the safety can be maintained, and the mounting of the connector to the panel hole can be simple.

Although the present invention has been fully described by way of example with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A movable connector comprising:

a plurality of movable locking arms each having a stopper at its top via a mounting base portion on the outer periphery of a connector holder;

a panel hole formed through a panel, into which said connector holder is inserted so as to engage said stopper with the rim of said panel hole, thereby movably mounting said connector holder to said panel hole by virtue of elasticity of said movable locking arms;

fixed locking members provided outside said movable locking arms and each having a stopper head at the top of a pin; and locking member receiving holes formed through the panel, whereby the bottom surface of the stopper head of one of said fixed locking members being blocked by the rim of the corresponding locking member receiving hole so as to re-lock said connector holder to the panel, when said connector holder moves toward one side and approaches or reaches a disengagement point where the movable locking arm on the opposite side is disengaged from said panel hole.

2. A movable connector according to claim 1, wherein the diameter of each pin is smaller than the diameter of the bottom surface of the stopper head of each fixed locking member, while the inner diameter of each locking member receiving hole is larger than the diameter of the bottom surface of the stopper head.

3. A movable connector according to claim 2, wherein said stopper head is formed into a conic type, a tapered disk type, or a tapered button type, having the bottom surface to be blocked by the rim of the corresponding locking member receiving hole.

* * * * *